US005516294A

United States Patent [19]

Andrews et al.

[11] Patent Number: 5,516,294

[45] Date of Patent: May 14, 1996

[54] COAXIAL INTERCONNECTION SYSTEM

[75] Inventors: Derek Andrews, Platanenstraat; Andrew G. Meller, Mozartlaan, both of Netherlands

[73] Assignee: Berg Technology, Inc., Reno, Nev.

[21] Appl. No.: 176,220

[22] Filed: Dec. 30, 1993

[30] Foreign Application Priority Data

Dec. 30, 1992 [NL] Netherlands ..... 92-02302

[51] Int. Cl.[6] ..... H01R 9/09

[52] U.S. Cl. ..... 439/63; 439/607; 439/610

[58] Field of Search ..... 439/607, 610, 439/668, 669, 92, 98

[56] References Cited

U.S. PATENT DOCUMENTS

| | | | |
|---|---|---|---|
| 3,208,030 | 9/1965 | Evans . | |
| 3,958,851 | 5/1976 | Evans . | |
| 4,820,175 | 4/1989 | Haselgawa et al. | 439/98 OR |
| 4,906,200 | 3/1990 | Miyake | 439/607 X |
| 4,975,066 | 12/1990 | Sucheski et al. | 439/668 X |
| 4,981,447 | 1/1991 | Ichitsubo | 439/610 X |
| 5,035,652 | 7/1991 | Shibano | 439/610 OR |
| 5,094,627 | 3/1992 | Uekido | 439/610 OR |
| 5,114,364 | 5/1992 | Hunter | 439/607 X |
| 5,160,272 | 11/1992 | Zell et al. | 439/607 X |
| 5,277,624 | 1/1994 | Champion et al. | 439/607 OR |
| 5,338,227 | 8/1994 | Nakamura | 439/610 X |

FOREIGN PATENT DOCUMENTS

| | | |
|---|---|---|
| 0131248 | 1/1985 | European Pat. Off. . |
| 1194558 | 11/1959 | France . |
| 1194558 | 5/1967 | France . |
| 2018376 | 11/1970 | Germany . |
| 628696 | 9/1949 | United Kingdom . |

*Primary Examiner*—P. Austin Bradley
*Assistant Examiner*—Daniel Wittels
*Attorney, Agent, or Firm*—Woodcock Washburn Kurtz Mackiewicz & Norris

[57] ABSTRACT

A connector system is provided with connectors, each of which comprises at least one shielded terminal. The shielded terminal has a ground contact and at least one signal terminal. The ground contact is substantially identical for signal conductors terminating either in a female, a male, or a hermaphroditic structure. The shielded terminal also has at least one lug extending beyond the shielded terminal. The signal terminal is either provided, at one end of the shielded terminal with at least one clamping lug which can be folded around the signal conductor of an electrical cable to establish a firm electrically conductive contact therewith, or it is integrally made with the signal conductor.

15 Claims, 10 Drawing Sheets

COAXIAL INTERCONNECTION SYSTEM

FIELD OF THE INVENTION

The present invention relates generally to connectors and, more particularly, to multi-cable connectors.

BACKGROUND OF THE INVENTION

U.S. Pat. No. 3,958,851 discloses a connector having an inner conductor to carry a voltage signal and an outer ground conductor. The ground conductor comprises two parts: the first part is a plastic member provided with a metallic coating and directly surrounding the inner conductor, and the second part is a shield member made from a punched conductive blank folded around the first part. The shield member comprises a lug extending from the connector in the longitudinal direction. The lug may be slid over the surface of another ground terminal of another, identical shaped connector in order to provide a good electrical contact. However, a part of the shield member has a rectangular shape, whereas the remaining part has a circular shape, thus a complex folding technique is needed during manufacturing. Furthermore, since the ground conductor comprises two parts the possibilities to miniaturize it are limited: the connector is not suited for application in modern microelectronics in which connectors comprising several shielded terminals within one housing are used and in which cross section dimensions of each shielded terminal are no more than a few millimeters. Moreover, because of the rather large dimensions of the connector the signal loss is too large for very high frequency applications and it is very difficult to design this connector for 50 ohm applications.

Other connectors comprising ground terminals having extending lugs are, for instance, known from FR-A-1.194.558, the additional French patent to this FR-A-1.194.558, and GB-A-626.696. These documents show several embodiments of connectors having extending ground lugs. However, all the embodiments shown in these references comprise ground terminals having at least two parts and are, therefore, similarly not suitable for miniature applications. Moreover, they only show circular shaped connectors of rather large dimensions, permitting large signal losses in very high frequency applications.

Another connector having extending ground lugs is disclosed in EP-A-0.414.495, in which coaxial terminals within a connector are described as having conventional circular cross-sections. Each connector may comprise more than one coaxial terminal, designed to be connected to a corresponding coaxial terminal of another connector. The signal conductor of the coaxial terminal terminates either in a male or in a female structure. The shape of the end of the ground contact of the terminal varies according to the terminal type: in a terminal whose signal conductor terminates in a male structure, the ground contact has four projecting lugs, while in the case of a terminal whose signal conductor terminates in a female structure, the ground contact has a closed cylindrical form which can be pushed into the four lugs of the ground contact of the first-mentioned terminal. Therefore, the connectors disclosed by prior art require the fabrication of various types of ground contacts, depending on the type of terminal for which the ground contact is intended. In this particular prior art connector, a design of the coaxial terminal is shown to bend through an angle of 90°. The ground contact of this design is obtained from a ground contact blank, which is punched from a flat plate and which, via folding over various small plates and via clamping lugs, provides a substantially electrically enclosed envelope. The various folding steps make a design of this type vulnerable to incorrect alignment and thus to impedance mismatch. Moreover, in this known coaxial terminal the signal terminal is soldered to the signal conductor. Soldering electrical connections, however, is time-consuming and relatively expensive. The known design is suitable for impedances of approximately 75Ω.

SUMMARY OF THE INVENTION

The object of the present invention is to provide a connector suitable for miniature applications and having at least one shielded terminal.

A further object of the present invention is to provide a connector showing low signal losses in very high frequency applications.

Moreover, it is an objective to provide a connector having a signal terminal which is connected to a signal conductor without using soldering techniques.

It is also an objective of the present invention to provide a connector suitable for use in 50 ohm applications.

Therefore, a connector is provided by the present invention in which the ground contact is formed from a single electrically conducting plate and has a substantially symmetrical polygon cross section along its entire length.

Such a connector is easy to be manufactured by well known punch and folding techniques. Moreover, since only single plate ground terminals are used the shielded terminal(s) of the connector may be easily miniaturized. One ground terminal may, for instance, have a rectangular cross section having a width of only about 1.8 mm and a height of about 1.8 mm. Moreover, such a ground terminal substantially shields the entire inner signal conductor(s), so the signal losses are significantly reduced. Impedance matching to 50 ohm transmission lines may be easily accomplished.

In a preferred embodiment the ground contact comprises two indented small faces at the same end at which the two lugs are situated. The indented small faces are situated on those lateral faces of the ground contact, respectively, from which no lugs extend.

The signal terminal in the connector may be provided with at least one clamping lug on one end, which is to be folded around a signal conductor of an electrical cable to which the connector is to be fitted, in order to establish a firm electrically conductive contact. By applying such a clamping lug no soldering of the signal terminal to the signal conductor is needed, thereby saving manufacturing time and money.

When the connector is to be fixed directly to a printed circuit board the signal terminal may be connected, to a signal conductor, which extends in the longitudinal direction within the shielded terminal. The signal terminal and the signal conductor are preferably made from a single piece of blank.

The connector defined above may comprise several shielded terminals arranged in several columns and several rows. The connector may for instance comprise 4 columns and 3 rows of shielded terminals. When the shielded terminals are of a coaxial type such a connector may have a cross section dimension having a width of about 12 mm and a height of about 8.4 mm. Each shielded terminal may be of a coaxial or twin-ax type.

Moreover, the connector may be mounted to a back panel. Common grounding of the ground contacts of the shielded terminals may be provided by a ground plate having openings through which the shielded terminals of the connector extend and spring fingers contacting ground pads attached to the back panel. By applying such a ground plate all ground contacts of the shielded terminals can be connected to ground without using individual wires or the like which would otherwise have to be soldered to the ground contacts and to the ground pads on the back panel thereby increasing manufacturing time. Moreover, such a ground plate is easily manufactured and does not limit the required miniaturization of the connectors. In some cases the ground plate may have a shielding effect against electromagnetic fields.

The invention further relates to a method of producing a ground contact for the connector defined above. A ground contact blank having one or more extending lugs extending from a flat plate of conductive material may be punched out of a single conductive plate. The ground contact blank is then folded over folding lines extending in the longitudinal direction of the ground contact blank in order to obtain a ground contact comprising a substantially symmetrical polygon cross section along its entire length.

In a preferred embodiment, the ground contact blank is provided with V-shaped openings which are arranged in such a way that after folding to produce the ground contact, the ground contact is folded once more to provide a substantially electrically enclosed ground contact which has a predetermined angle.

BRIEF DESCRIPTION OF THE DRAWINGS

The invention will be described in more detail below with reference to the accompanying drawings, which are intended to illustrate the invention, rather than to limit it. The drawings show the following figures:

FIG. 9 shows a spacer between a ground contact and a signal conductor;

FIG. 13 shows, partly in a cross section view and partly in an exploded view, a connector mounted to a back panel, in which the ground plate of FIGS. 12*a* and 12*b* is used.

DETAILED DESCRIPTION OF THE EMBODIMENTS

Figure 1:
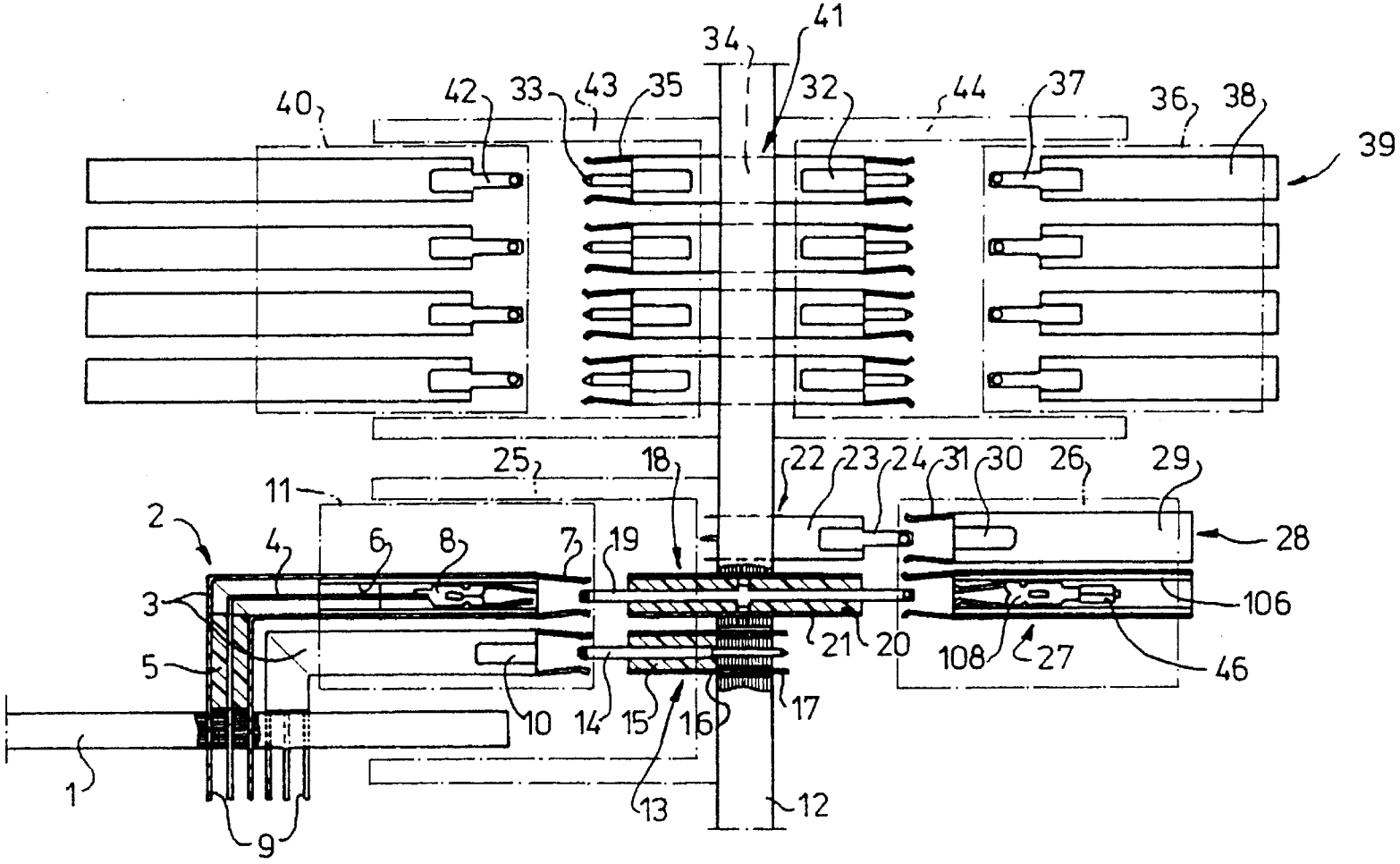
FIG. 1 shows an overview of a coaxial interconnection system.

In FIG. 1, various options are shown for a coaxial interconnection system. On a printed circuit board 1 there is a coaxial terminal 2, which is arranged so as to be bent through an angle of 90°. In FIG. 1, within a housing 11, indicated by a dot-and-dash line, two coaxial connections are shown in a side view. In the housing 11 there is, however, enough room for a third coaxial terminal as can be seen from the figure. Overall, the housing 11 may, for example, contain twelve coaxial terminals, arranged in four columns and three rows. Such a housing 11 may have an approximate width of only 12 mm and an approximate height of only 8.4 mm.

As shown in the cross-section of the coaxial terminal 2 depicted in FIG. 1, each coaxial terminal comprises at least a ground conductor 3 and a signal conductor 4. Further illustrated in this cross-section is a signal terminal 8 which is formed from a single plate with the signal conductor 4, as will be described hereinafter in more detail. Between the ground contact 3 and the signal terminal 8 there is an insulating wall 6. Between the signal conductor 4 and the ground contact 3 there are insulating means, for example in the form of one or more insulating blocks 5. The ground contact 3 is connected, so as to be electrically conductive, with ground lugs 7 which extend beyond the insulating wall 6. The ground lugs 7 can be brought into electrically conductive contact with the ground contact 21 of a coaxial terminal 18, as will be described later in more detail. The signal terminal 8 can be brought into conductive contact with a signal conductor 19 of the coaxial terminal 18.

The coaxial terminal which is located within and at the bottom of the housing 11 is seen in side view. The figure, therefore, shows the lateral face of the ground contact 3, which is folded rectangularly about the signal conductor 4, as will later become clearer with reference to FIGS. 5, 6*a* and 6*b*. On the visible face of the ground contact 3, there is an indented small face 10, over which a ground lug (not shown) of a coaxial connection point 13 can be slipped. The ground contact 3 is bent through an angle of approximately 90° and as a result, the coaxial terminal extends substantially parallel to the surface of the printed circuit board 1. The ground contact 3, by means of pins 9, projects through the surface of the printed circuit board 1. If required, a printed ground conductor on the printed circuit board 1 can be soldered to the pins 9.

The housing 11, together with part of the printed circuit board 1, can be pushed into a housing 25. The housing 25 is indicated by a dot-and-dashed line. Coaxial terminals 13 and 18 are located within the housing 25 as shown. The coaxial terminals 13 and 18 are fastened to a second printed circuit board 12. In this case, the coaxial terminal 18 projects through the second printed circuit board 12, while the coaxial terminal 13 extends substantially to one side of the second printed circuit board 12. The ground contact 16 of the coaxial terminal 13 has pins 17, which project through the second printed circuit board 12, while the signal conductor 14 of the coaxial terminal 13 also projects through the second printed circuit board 12. The coaxial terminal 13 thus terminates, as it were, on the second printed circuit board 12. The signal conductor 14 is electrically connected (in a manner not shown) to printed conductors on the second printed circuit board 12, on which there may be electronic components. The ground pins 17 are connected to a printed ground conductor (not shown) on the second printed circuit board 12.

The coaxial terminal 18, in its entirety, passes through the second printed circuit board 12, in such a way that the signal conductor 19 does not make electrical contact with printed conductors on the second printed circuit board 12.

FIG. 1 shows a side view of another coaxial terminal 22. This further coaxial terminal 22 extends substantially to the right-hand side of the printed circuit board 12, in order to be able to electrically contact a coaxial terminal 28, which forms part of a connector of a coaxial cable (not shown). In FIG. 1, the lateral face 23 of this further coaxial terminal 22 is shown, on which face 23 there is a lug 24. The lateral face 23 is made of an electrically conductive material and serves as the ground contact, while the ground lug 24 has the same shape and function as the earlier-mentioned ground lug 7, although ground lug 24 in this case corresponds to a top view of the ground lug 7 shown in side view. The ground lug 24 can electrically contact an indented small face 30 of the ground contact 29 of the coaxial connection point 28. Rotated through an angle of 90° with respect to the ground lug 24, the coaxial terminal 28 comprises two ground lugs 31, which can electrically contact with indented small faces (not shown) situated on the top face and bottom face of the ground contact 23. Below the coaxial terminal 28, a cross-section is shown in FIG. 1 of a coaxial terminal 27 which along with coaxial terminal 28 form part of the same coaxial cable (not shown). The design of the coaxial terminal 27 is substantially identical to that of coaxial terminal 28. A signal terminal 108 within the coaxial terminal 27 differs somewhat from the signal terminal 8 within the coaxial terminal 2: a signal conductor (not shown) of the coaxial cable, with which the coaxial terminal 27 is associated, can be connected, with the aid of clamping lugs 46, to the signal terminal 108 in an electrically conductive manner, as will be explained with reference to FIGS. 2*a–c* below.

Within the housing 26 of the connector shown in Figure 1, two coaxial terminals 27 and 28 are shown above one another. Preferably enough room within the housing 26 is provided for a third coaxial terminal below the coaxial terminal 27 as shown in the figure. The housing 26 of the connector extends, in a direction perpendicular to the plane of FIG. 1, to such an extent that the housing 26 of the connector provides room for four columns of three rows of coaxial terminals. The housing 26 of the connector in this example, therefore, has room for a total of twelve coaxial terminals. Obviously, the housing 26 of the connector can also be of different dimensions, and as a result different numbers of coaxial terminals can be accommodated.

In the upper part of FIG. 1, a side view of a part of the coaxial interconnection system is shown which comprises four coaxial terminals located above one another. To the top and to the right of the figure, a housing 36, indicated by a dot-and-dash line, of a connector of a coaxial cable is shown, within which there are four coaxial terminals of which one is identified by reference numeral 39. The coaxial terminal 39 is shown in side view. This side view shows a ground contact 38 and a ground lug 37 connected thereto in an electrically conductive manner. The ground lug 37 can be pushed over an indented small face 32 of the ground contact 34 of a coaxial terminal 41 on the second printed circuit board 12. The ground contact 34 again has two ground lugs 35, which are rotated through an angle of 90° with respect to the ground lug 37. The ground lugs 35 again can interact with the indented small faces (not shown) on the ground contact 38 of the coaxial terminal 9. Each ground contact of each coaxial terminal thus preferably comprises two ground lugs which can interact with two indented small faces on a ground contact of another coaxial terminal interacting therewith. This other coaxial terminal in turn also comprises two ground lugs, which, however, are rotated through an angle of 90° with respect to the first-mentioned two ground lugs. As can be seen from FIG. 1, all types of coaxial terminals, i.e. both those of which the signal conductor 4 is connected to a signal terminal 8 having a female shape, and those with a signal conductor 19 having a male shape, have the same design with respect to the ground contact and the two ground lugs. In that sense, the ground of each coaxial terminal is hermaphrodite. It is to be noted that it is preferable for each ground contact (for example 3) to be designed to have two lugs (for example 7), but that in principle it is also possible to have ground contacts with one lug or with more than two lugs, even though the design becomes more complex if there are more than two lugs.

The coaxial interconnection system which is shown at the top of FIG. 1 illustrates that the housing 36 of a connector of a coaxial cable, having, for example, a total of twelve coaxial cables to one side of the printed circuit board 12, can be coupled with an inter-connector, which then likewise comprises twelve coaxial terminals and which is situated, at the top of FIG. 1, on the printed circuit board 12, and whose coaxial terminals all project through the printed circuit board. All these coaxial terminals projecting through the printed circuit board 12 in FIG. 1 have the same design, namely a signal conductor 33 having a male shape. Then signal conductor 33 can be coupled with a female signal terminal (not shown) of an interacting coaxial terminal, for example 39.

In the same way, the housing 36 of a coaxial cable connector can interact with the housing 44 on the right-hand side of the printed circuit board 12, and a housing 40 of another coaxial cable is able to interact with a housing 43 provided with coaxial terminals on the left-hand side of the printed circuit board 12. It is thus possible to use groups of coaxial terminals, which project through the printed circuit board 12, as an interconnection system for two coaxial cables whose signal terminals are of the same type, so that these two coaxial cables cannot be coupled directly to one another. In FIG. 1, housings 43 and 44, respectively, are shown on the left-hand and right-hand side, respectively, of the printed circuit board 12, which housings are able to interact with the housings 40 and 36, respectively, of different coaxial cables. Housings 43 and 44 of this type make it considerably simpler to connect the connectors of coaxial cables to groups of coaxial terminals on the printed circuit board 12, but they are not strictly necessary.

FIG. 1, therefore, gives an overall view of various possibilities of the present coaxial interconnection system, Thus, connectors of coaxial terminals on two different printed circuit boards 1 and 12 can be connected to one another. Coaxial terminals, if required, may project through a printed circuit board. Coaxial terminals on a printed circuit board can be shaped and grouped in such a way that they can serve as an interconnection system for two coaxial cables. Coaxial terminals (for example 13 and 22) may also terminate on a printed circuit board.

Figure 2A:
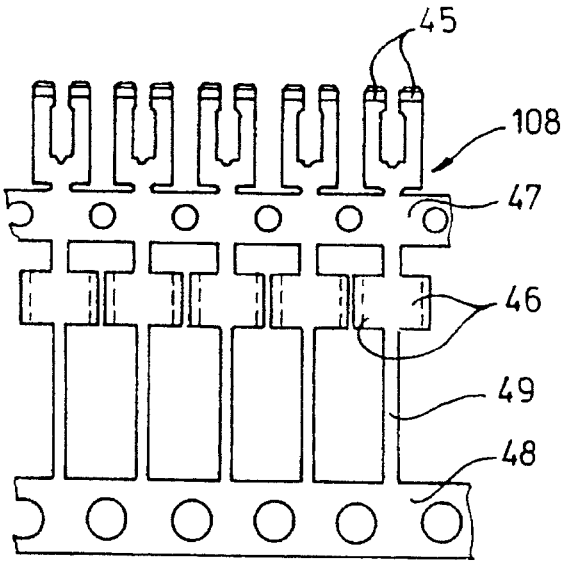
FIGS. 2*a–c* show various steps during the fabrication of terminals for signal conductors in coaxial cables.
Figure 2B:
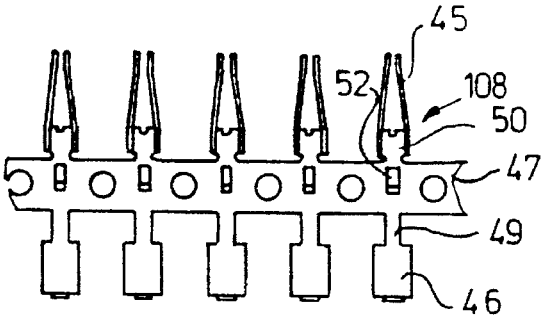
Figure 2C:
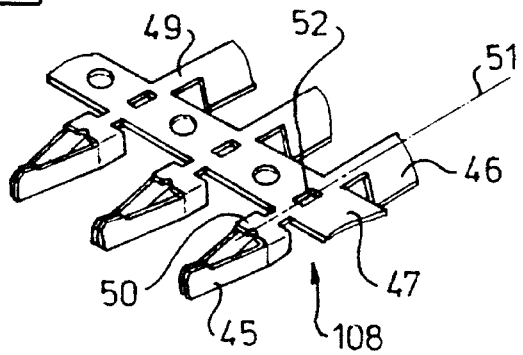

Due to the special design of coaxial terminals, they may have particularly small dimensions. A fabrication method for the coaxial terminals will now be explained with reference to the following figures. FIGS. 2*a–c* show how a signal terminal 108 can be fabricated which is especially designed for coaxial cables. The process starts with a flat plate of suitable material, from which several blanks, which in FIG. 2*a* are still flat, for signal terminals 108 are punched out. The various flat blanks for the terminals 108 are still connected to one another via webs 47 and 48. Each signal terminal 108 comprises two signal conductor lugs 45 and at least one clamping lug 46. The clamping lugs 46 extend laterally from a thin web 49, which connects the wider webs 47 and 48 to one another. This is shown in FIG. 2*a*.

The narrower webs 49 are preferably cut through near the clamping lugs 46. The signal conductor lugs 45 may then be bent through an angle of, substantially, 90° with respect to a supporting surface 50 connected to the wider web 47. As can be seen from FIG. 2*b*, the signal conductor lugs 45 at their ends have also been bent towards one another, being pre-tensioned as a result with respect to a conductor pin of a male coaxial terminal, with which said signal conductor lugs 45 are to interact. On the other side of the wider web 47, part of the narrower web 49 then still extends from, as already mentioned, one or two clamping lugs 46 project. The clamping lugs 46 are folded over with respect to the narrower web 49. A perspective view of several signal terminals 108 placed next to one another is shown in FIG. 2*c*. If, for example, there are two clamping lugs 46, these can be bent towards one another about a line 51 indicated by a dot-and-dashed line as shown. The signal terminals 108, which are still connected to one another, are preferably then separated by cutting through the wider web 47. In this way it is possible to obtain signal terminals 108 with very small dimensions.

The signal terminal 108 may then be connected to a signal conductor of a coaxial cable (not shown) by firmly clamping together the clamping lugs 46, after the signal conductor in question has been placed between them. The signal terminal 108 as a whole can then be placed in an insulating casing 106 (FIG. 1). Between the signal terminal 108 and the insulating walls 106 there may be a compression joint, for example by projections 52 being formed on the wider web 47 between the supporting surface 50 and the thinner web 49 (see FIGS. 2*b* and 2*c*), so that these which projections 52 provide a friction joint with the insulating walls 106.

Figure 3A:
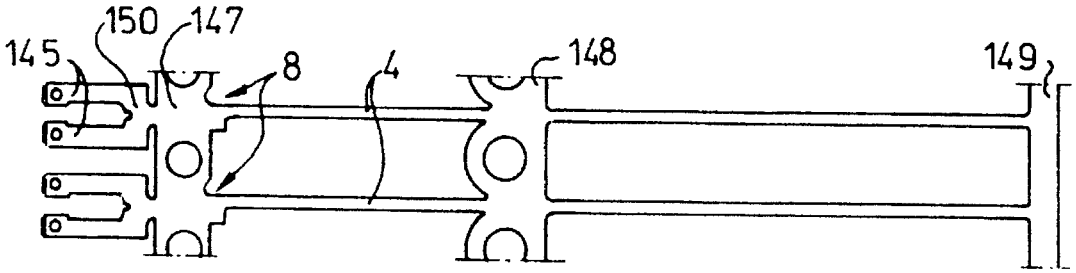
FIGS. 3*a–c* and 4 show various steps during a fabrication method of terminals for signal conductors in a coaxial connector, the signal conductors being designed to be connected to a printed circuit board.
Figure 3B:
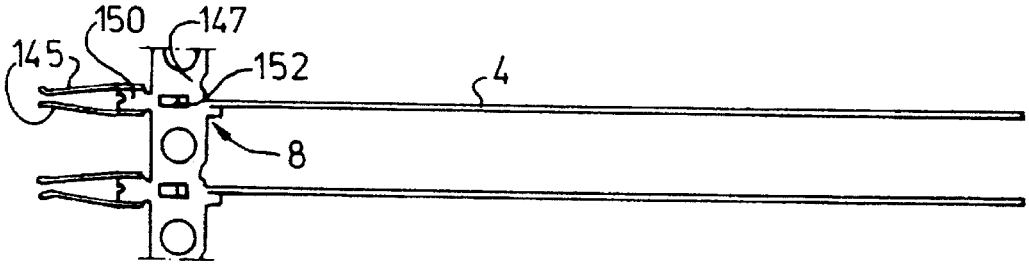
Figure 3C:
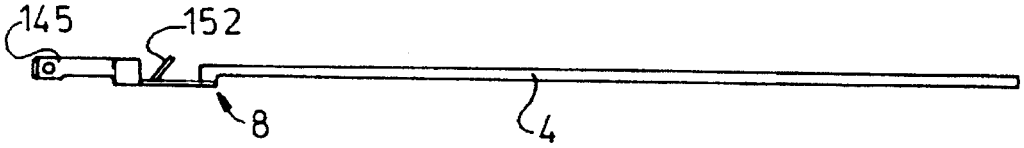

FIGS. 3*a–c* show how a signal terminal 8 and a signal conductor 4 can be punched from a single plate and thus can be adapted for use in a coaxial connector placed on a printed circuit board 1. FIG. 3*a* shows a blank, still in flat form, as can be punched from a flat plate. On one end of the blank there are two signal conductor lugs 145, which are connected to one another via a supporting surface 150. The supporting surface is connected to a web 147, which connects adjacent signal terminals 8 to one another. The signal terminal 8 has been punched from a single plate together with a signal conductor strip 4 which, via a second web 148 and a third web 149, is connected to an adjacent signal conductor strip 4. The signal conductor strip 4 is cut through near the third web 149. The signal conductor strip 4 is separated from its adjacent signal conductor strip (or signal conductor strips) by cutting the second web 148 between two adjacent signal conductor strips 4. The flat signal conductor strip 4 is then rotated through an angle of 90° about the junction point between the signal conductor strip 4 and the signal terminal 8, so that the entire signal conductor strip 4 ends up in a position perpendicular to the plane of the drawing of FIG. 3*a*. Finally, the two signal lugs 145 are each bent through an angle of 90° with respect to the supporting surface 150, so that the view of FIG. 3*b* is obtained. In FIG. 3*b*, a projection 152 has been drawn in addition, which provides a compression joint with an insulating casing 6, in which the signal terminal 8 is placed. FIG. 3*c* shows a side view of the design thus obtained.

Neither the design of a signal terminal 148 according to FIGS. 2*a–c*, nor of a signal terminal 8 according to FIGS. 3*a–c* require a soldered connection between the signal terminal 8 and 108 and a signal conductor 4.

Figure 4:
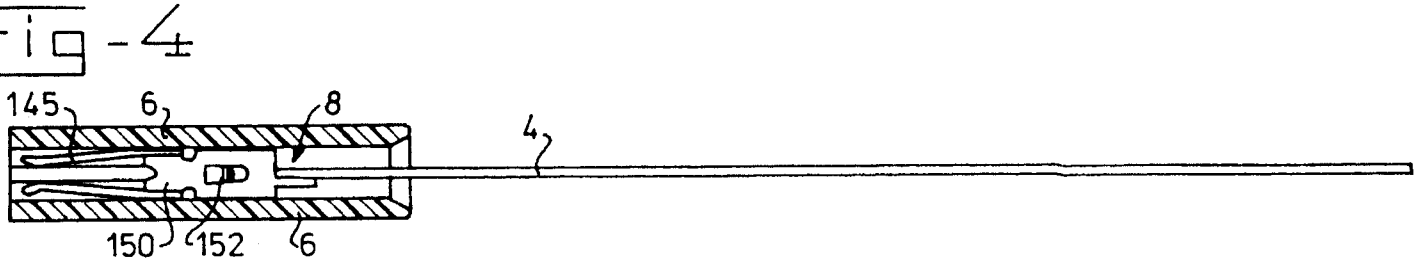

FIG. 4 shows a signal terminal 8, obtained according to the steps described above in connection with FIGS. 3*a–c*, having a signal conductor 4 in an insulating casing 6. The insulating casing 6 substantially encloses the signal terminal 8 in its entirety and has a compression joint with the projection 152.

Figure 5:
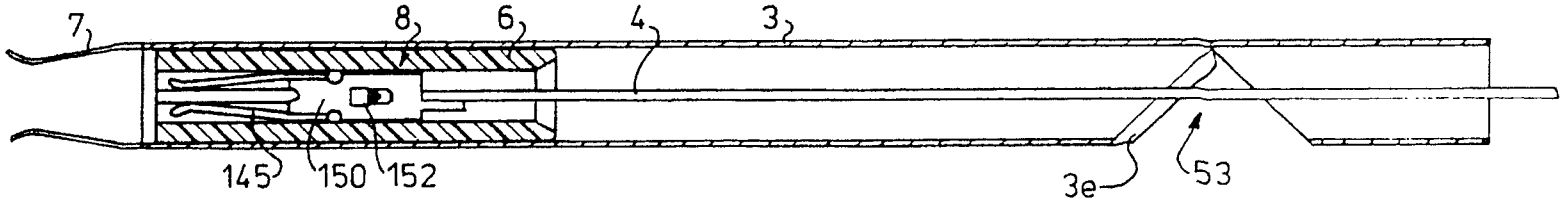
FIG. 5 shows a side view of a coaxial terminal provided with a ground conductor.
Figure 5:
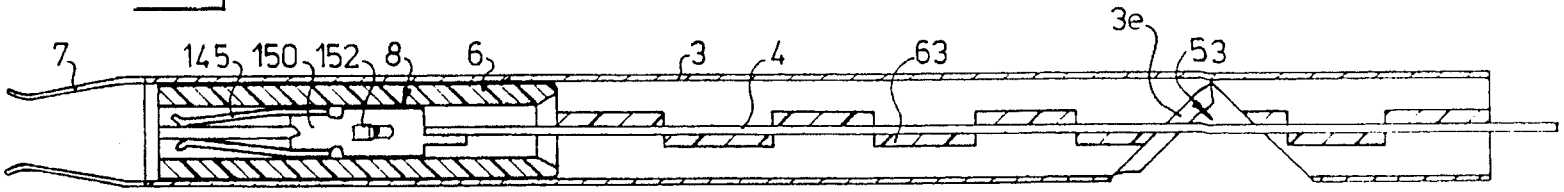
Figure 6A:
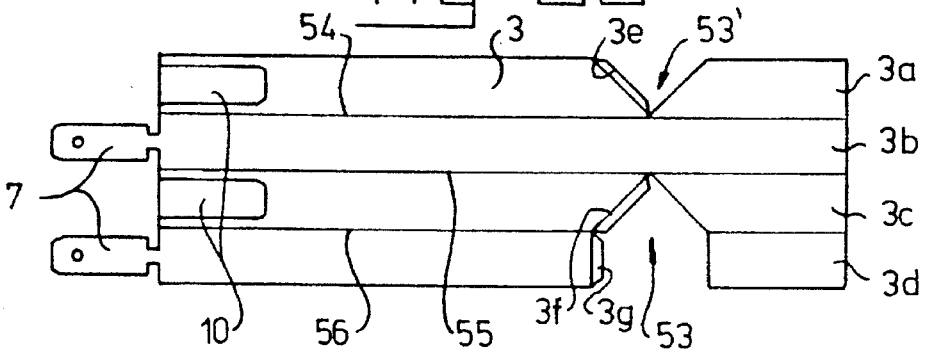
FIGS. 6*a* and 6*b* show a loose component which is used to fabricate the ground conductor for the coaxial terminal according to FIG. 5.
Figure 6B:
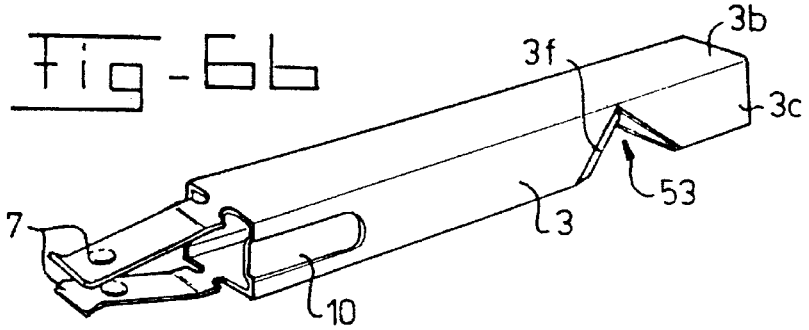

FIG. 5 shows the assembly according to FIG. 4, which has been pushed into a ground contact 3. The ground contact 3 is provided with ground lugs 7. FIG. 6*b* shows a perspective view of the ground contact 3 provided with the ground lugs 7. The ground contact 3, like the signal terminal 8, is fabricated from a flat plate of suitable conductive material. This is shown in FIGS. 6*a* and 6*b*. FIG. 6*a* shows the ground contact 3, after it has been punched from a flat conductive plate and before it has been folded into the correct shape. The ground contact 3 according to FIG. 6*a* then preferably has two projecting ground lugs 7, two indented small surfaces 10 and V-shaped notches 53 and 53'. Near the V-shaped opening 53 and 53', projecting flaps 3*e*, 3*f*, and 3*g*, respectively, are attached to the strips 3*a*, 3*c* and 3*d*, respectively.

On the ground contact 3, while it is still flat, three folding lines 54, 55 and 56 are arranged, which divide the ground contact 3 into four parts 3*a*, 3*b*, 3*c* and 3*d*. As shown in FIG. 6*a*, there are two indented small faces 10 on the strips 3*a* and 3*c*, respectively, while the two ground lugs 7 extend from the strips 3*b* and 3*d*, respectively. The ground contact according to FIG. 6*b* is now produced from the flat ground contact 3 according to FIG. 6*a* by folding the flat ground contact along the folding lines 54, 55 and 56 through an angle of 90° each. The strip 3*b* is then situated, for example, on the top of a rectangular ground contact 3 (FIG. 6*b*), while the strip 3*c* is then situated laterally on the front side shown in the figure. Strip 3*a* is situated at the back of the ground contact 3 according to FIG. 6*b*, and strip 3*d* is at the bottom. In this manner, the two ground lugs 7 of the folded ground contact 3 are located opposite one another. Similarly, the two indented small faces 10 on the strips 3*a* and 3*c* are now located opposite one another. Furthermore, the ground lugs 7 are always positioned so as to be twisted by an angle of 90° with respect to the indented small faces 10. The two ground lugs 7 are preferably slightly bent towards one another, so that they have a certain mechanical pre-tension. It can easily be seen that the ground contact 3 shown in FIG. 6*b*, can interact with an identical ground contact 3 which, however, has been rotated 90°, so that, for example, strip 3*c* is at the top. In that case, the ground lugs 7 and the indented small faces 10 can interact effectively with similar ground lugs and indented small faces of the other ground contact which has been rotated 90°. A ground contact 3 of this type can be placed over a signal conductor 4 which has either a female or a male terminal. Consequently, as stated earlier, the ground contact 3 can be referred to as a hermaphrodite.

Figure 7:
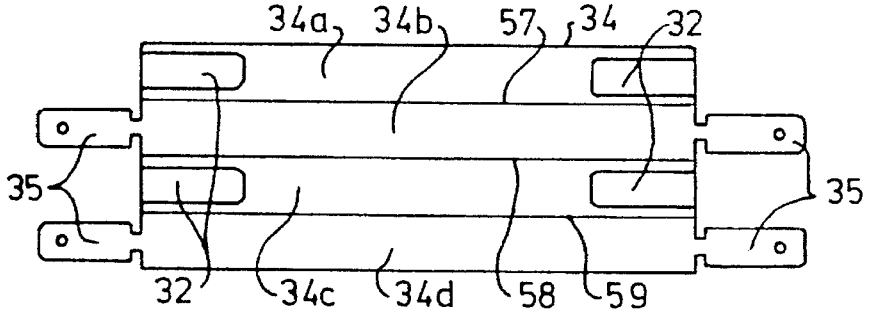
FIGS. 7 and 8 show alternative components for fabricating ground connections in coaxial connectors.

FIG. 7 shows a punched-out ground contact 34, still flat, which can be used for a coaxial terminal which, as a whole, projects transversely through a printed circuit board 12 (compare FIG. 1). The ground contact 34 comprises three folding lines 57, 58 and 59, which divide the ground contact 34 into four strips 34*a*, 34*b*, 34*c* and 34*d*. A total of four ground lugs 35 project from the conductor strips 34*b* and 34*d*. On the two other strips 34*a* and 34*c* there are, in total, four indented small faces 32, which can interact with ground lugs of other ground contacts. By folding the flat design of the ground contact 34 shown in FIG. 7 along the folding lines 57, 58 and 59 an angle of 90°for each, a rectangular ground contact 34 is produced similar to the ground contact shown in FIG. 6*b*. A side view of such a rectangular construction of the ground contact 34 can be seen in FIG. 1. Within such a ground contact 34, a signal conductor 33 may be separated from the ground contact 34 with the aid of a suitable insulating means (for example, insulator 20 shown in FIG. 1).

Figure 8:
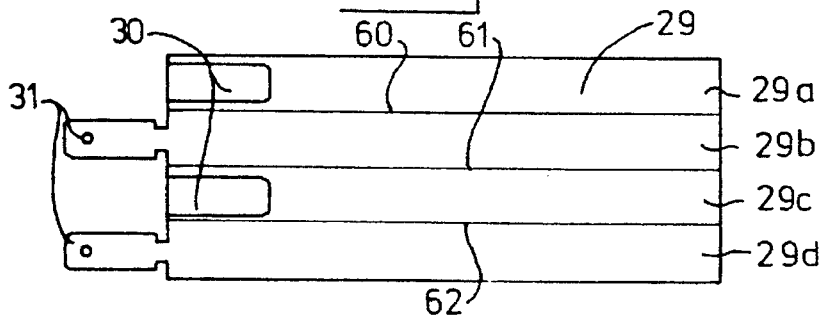

FIG. 8 shows a flat ground contact 29 that can be used for a coaxial terminal 28 (FIG. 1). The ground contact 29 is provided with two ground lugs 31 and two indented small faces 30 which are positioned on alternate strips of the ground contact 29. Four adjacent strips 29*a*, 29*b*, 29*c* and 29*d* are provided, which are separated from one another by folding along lines 60, 61 and 62. The flat design according to FIG. 8 can result in a rectangular ground contact 29 by folding the design along the folding lines 60, 61 and 62 through an angle of 90° in each case. A side view of such a rectangular ground contact 29 can be seen in FIG. 1.

FIG. 9 shows the result of the next step taken after following those steps described above in connection with FIG. 5. After the ground contact 3 is formed as shown in FIG. 6*b*, a spacer 63 is pushed into the ground contact 3. The spacer 63 prevents substantially any electrically conductive contact between the signal conductor 4 and the ground contact 3. The spacer 63 may have any suitable shape.

Figure 10:
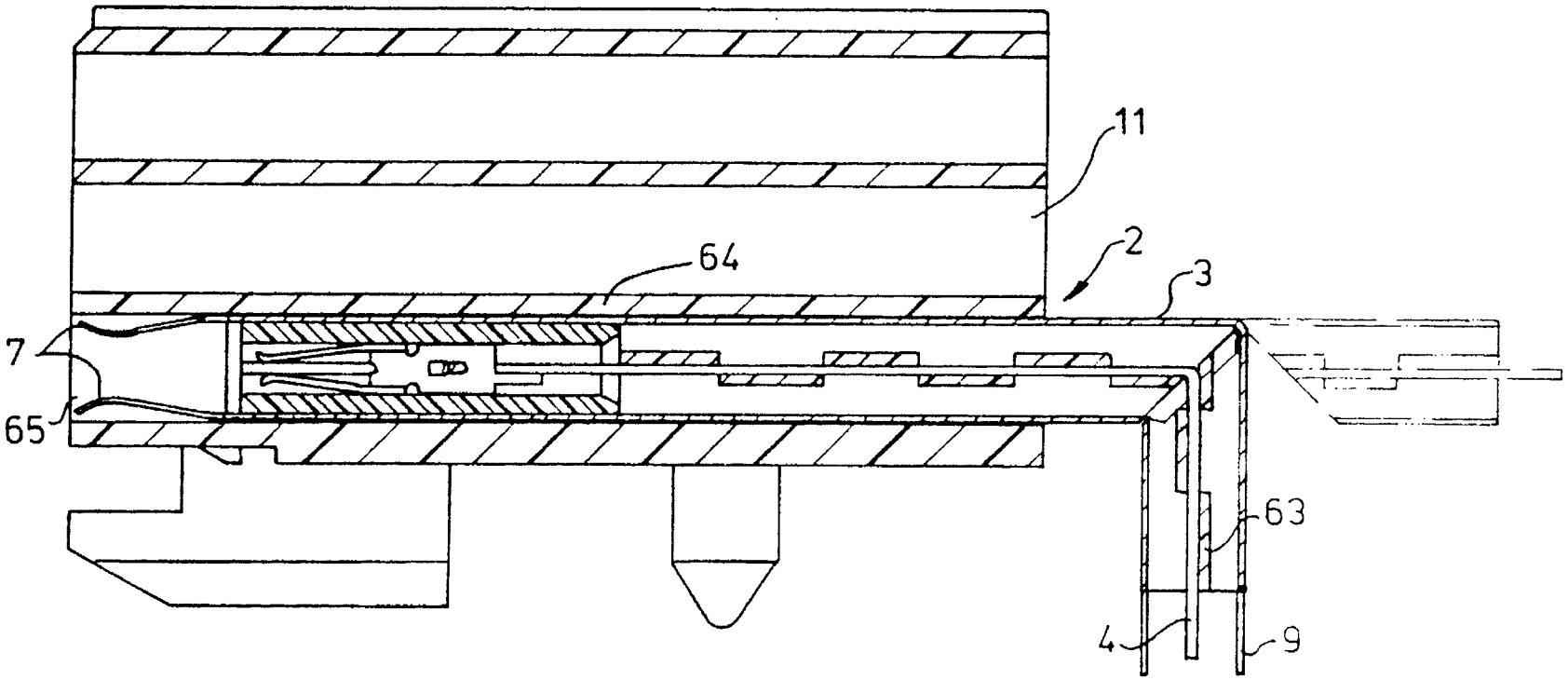
FIG. 10 shows a coaxial connection part according to FIG. 9 in a housing.

Once the design according to FIG. 9 has been achieved corresponding to a complete coaxial terminal 2 (FIG. 1), a housing 11 (FIG. 1) can be provided with coaxial terminals 2. This is illustrated in FIG. 10. FIG. 10 shows a coaxial terminal 2 which has been pushed into an opening 65 of the housing 11. On the left-hand side of the figure, part of the opening 65 is still free for receiving a coaxial terminal with a male signal conductor, as is indicated in FIG. 1, for example, by reference numeral 18. On the right-hand side of FIG. 10, a part of the coaxial terminal 2 projects from the housing 11, specifically with a part of the ground contact 3 within which the signal conductor 4 is situated. The ground contact 3, which projects from the housing 11, initially comprises at least the V-shaped opening 53. The function of the V-shaped opening is explained in more detail in FIG. 10. Folding up the V-shaped opening 53 produces a design, bent 90°, which can easily be achieved because the plane of the signal conductor 4 is perpendicular to the plane of the drawing according to FIG. 10. The ground contact 3 can be provided with pins 9 which can be plugged into holes in the printed circuit board 1, which are designed for this purpose. The same applies to the projecting part of the signal conductor 4. The pins 9, at the start of the fabrication process of the ground contact 3, can easily be formed at the same time by adjusting the punch, so that they form one whole with the ground contact 3. FIG. 10 illustrates that the flap 3*f* seals off the folded-up V-shaped opening 53 in order to further reduce electromagnetic interference. The flaps 3*e* and 3*g* (not visible) have the same function as flap 3*f*. In this way it is possible to provide a connector on a printed circuit board, in which the housing 11 is at an angle of 90° with respect to the plane of the printed circuit board. The housing 11 may, if required, also be at an angle other than 90° with respect to the printed circuit board 1, namely by setting the V-shaped openings 53 and 53' at a different predetermined angle.

It will be clear from the above that signal terminals 108 having a female structure can be punched and formed from a single plate, and without soldering can be connected to signal conductors of coaxial cables in a firm, electrically conductive manner. It is further possible to provide signal terminals 8 and a signal conductor 4 which are formed from a single plate. Likewise, a ground contact 3 with a hermaphrodite structure is provided, which is formed from one plate by means of punching and folding. In this way it is possible to obtain very small and very reliable coaxial terminals. The internal diameter of each coaxial terminal may, for example, be about 1.6 mm, the external diameter being less than 2 mm. By choosing the dimensions correctly, an impedance of 50 ohm for analog signals can be easily provided. Within a housing 11 of a connector having dimensions of approximately 8.4×11.95 mm in cross-section, twelve coaxial terminals can easily be arranged, for example, in four columns of three rows.

It should be understood that numerous variations of the present invention are possible. Thus, a rectangular cross-section of the ground contact is not strictly necessary. The ground contact may also comprise a different even number of flat lateral faces, in which the lateral faces alternately do and do not comprise ground lugs. Fewer ground lugs are also possible, as long as the orientation is such that a coaxial terminal whose signal conductor terminates in a female structure can interact with another coaxial terminal whose signal conductor terminates in a male structure.

Moreover, the use of clamping lugs 46 in a signal terminal 108 is not restricted to signal terminals of a female design. Even in the case of male signal terminals, clamping lugs 46 of this type can be used advantageously.

Figure 11:
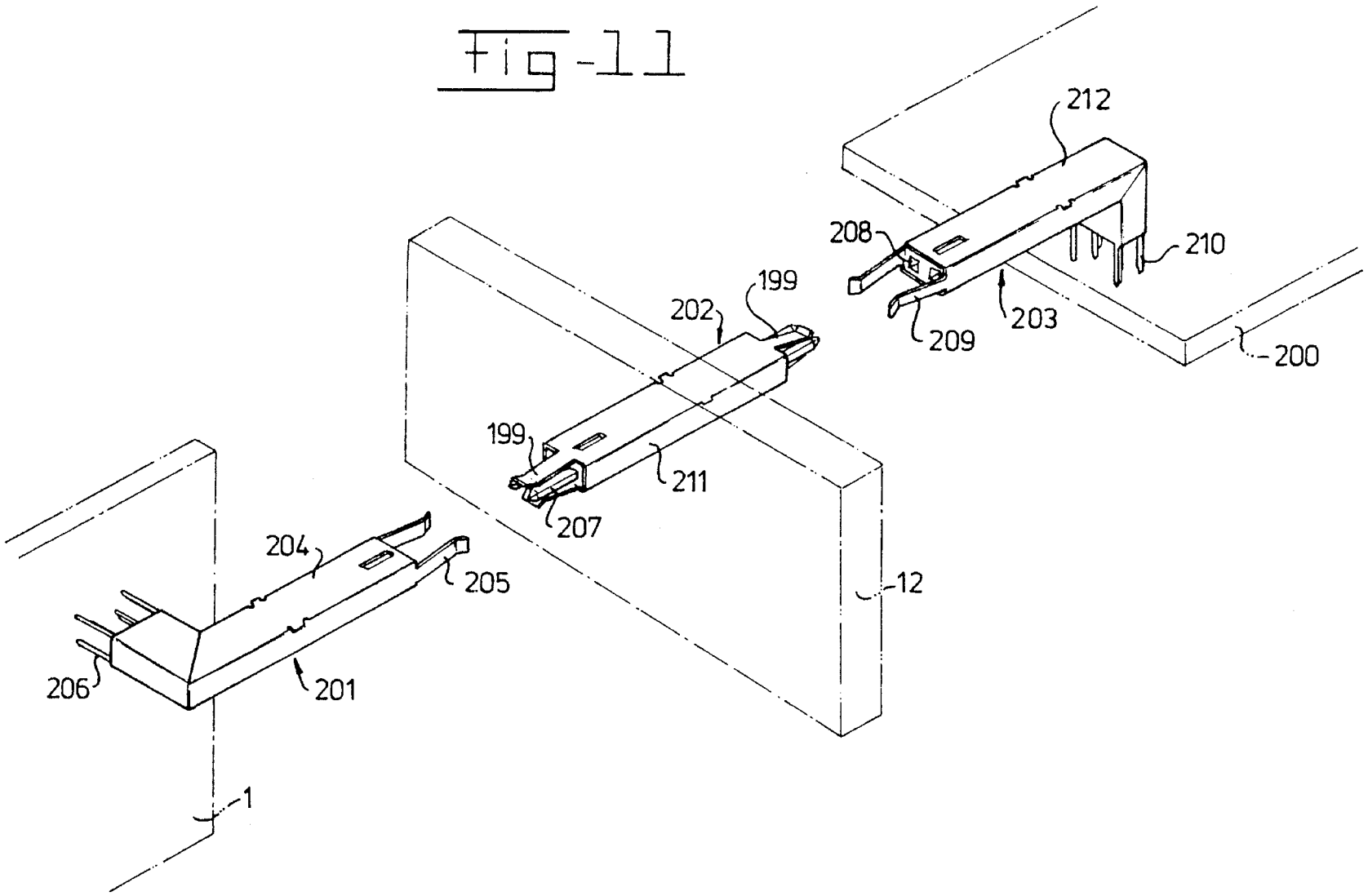
FIG. 11 shows a connection system based on twin-ax type connection elements.

Furthermore, the invention is not restricted to shielded connections having only one signal conductor within a ground contact. FIG. 11 shows a further embodiment of the present invention which relates to a twin-ax system, i.e. shielded connections provided with two signal conductors within the shielding member, such that the signal conductors may carry a differential mode signal. Three twin-ax connection elements 201, 202 and 203 are shown. The twin-ax connection elements 201 and 203, respectively, have ground contacts 204 and 212, respectively, provided with extending lugs 205 and 209, respectively. Twin-ax connection element 201 may be fixed to a printed circuit board 1, schematically depicted by dotted lines, by means of pins 206, while twin-ax connection element 03 may be fixed to a printed circuit board 200 by pins 210. These pins may be soldered or press-fit.

Both twin-ax connection element 201 and 203 have two openings 208 each accommodating a female type signal terminal (shown in FIG. 3 above). The openings 208 are each designed to receive a male type signal terminal 207 of a mating twin-ax connection element 202. The latter twin-ax connection element 202 can also be provided with extending lugs 199 which may be slid along the surface of the ground contacts of the mating twin-ax connection elements 201 and 203, respectively, when connecting the twin-ax connection element 202 to the twin-ax connection elements 201 and 203, respectively. Then, the extending lugs 205 and 209, respectively, may be slid along the surface of the ground contact 211 of the twin-ax connection element 202.

The twin-ax connection element 202 may pass through a back-panel 12, as shown in FIG. 11.

Figure 12B:
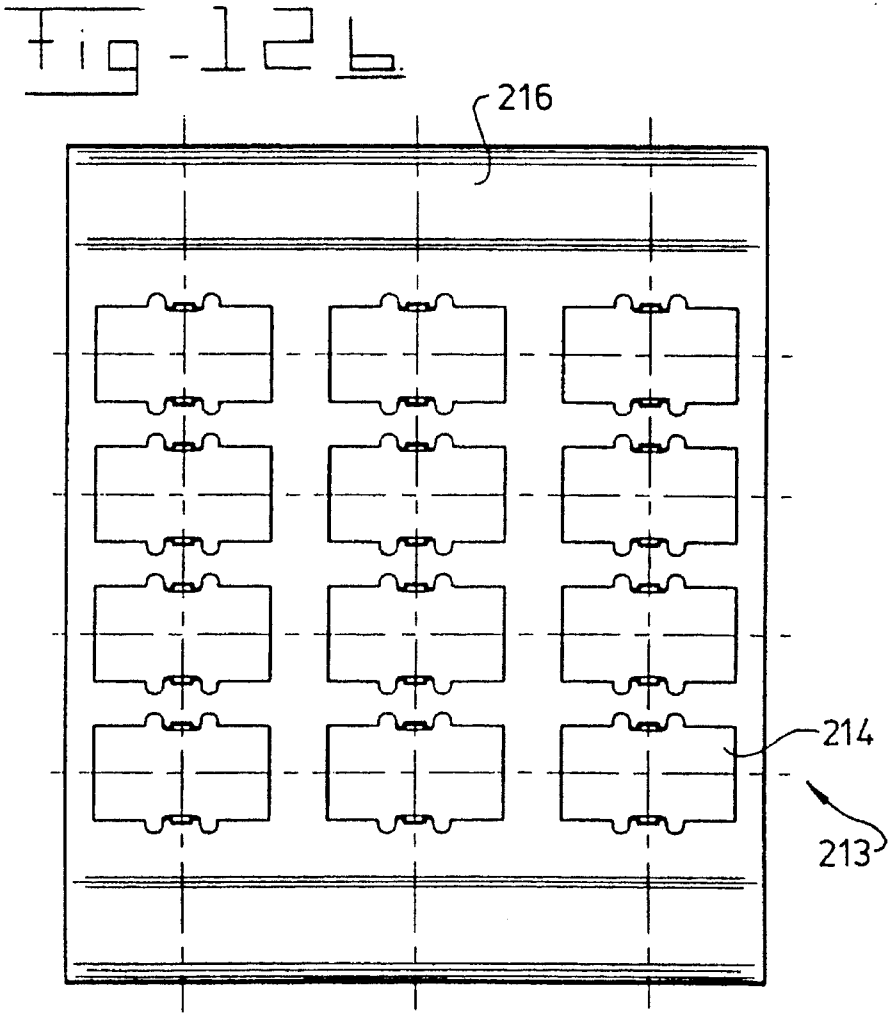
FIGS. 12*a* and 12*b* show a ground plate to be used to ground the ground contacts of the shielded terminals within one connector.

In a preferred embodiment several twin-ax connections elements are grouped together within a single housing 218 as shown in FIG. 13 and arranged, for instance, in three columns and four rows. Each ground contact 211 of each twin-ax connection element 202 should preferably be connected to common ground pads 217 on the back-panel 12 through which each twin-ax connection element 202 extends. In order to avoid many separate ground connections and soldering wires or the like to the ground pads 217 and to the ground contact 211, preferably, a ground plate 213 is used which is shown in FIGS. 12*a* and 12*b* on an enlarged scale.

Figure 12A:
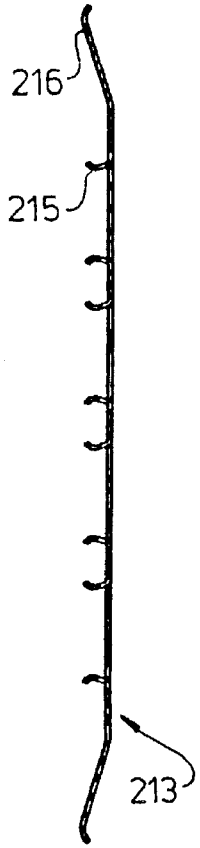
Figure 17:
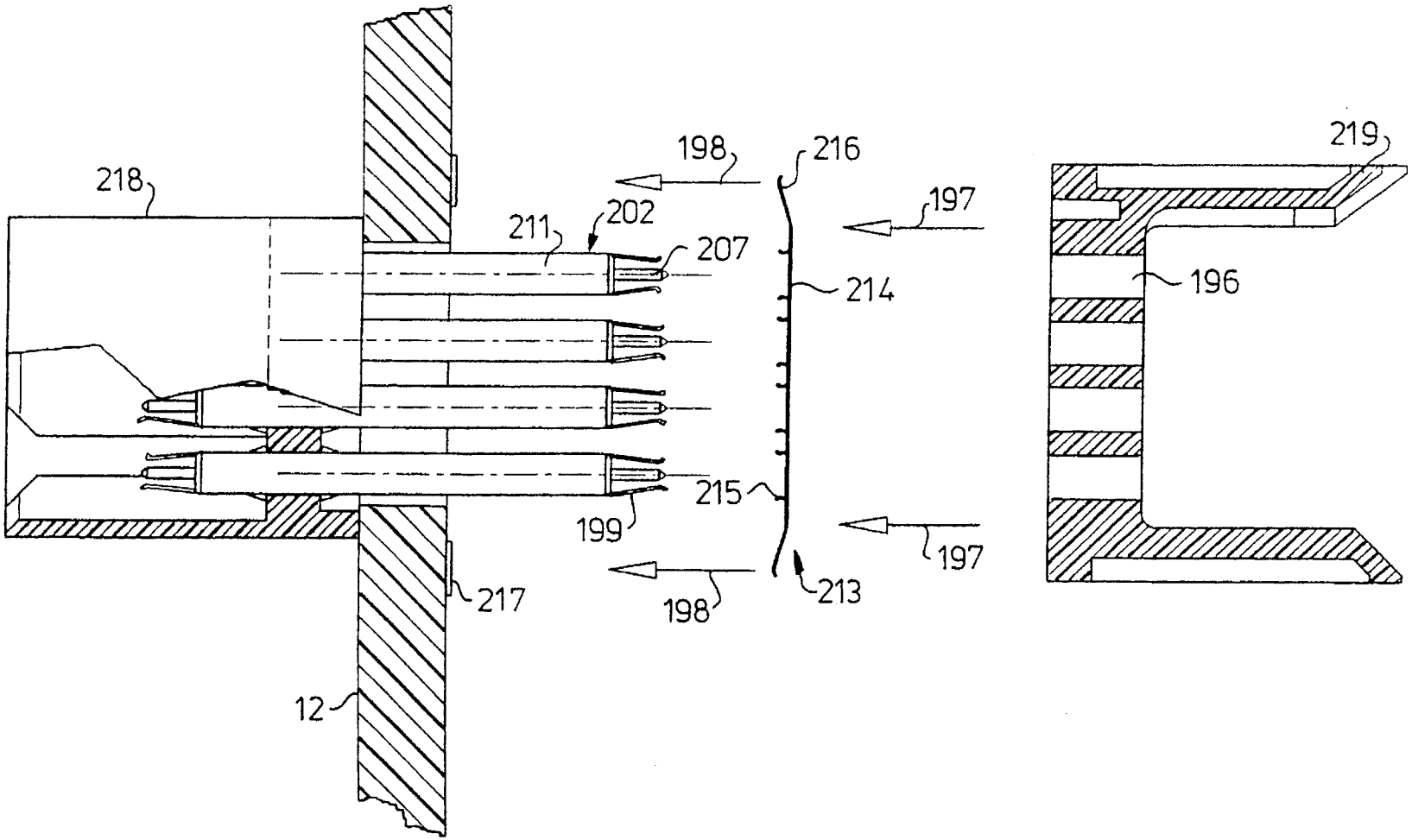

FIG. 12*a* shows a side view of the ground plate 213 which is made of a resilient conducting material. FIG. 12*b* shows a front view of the ground plate 213. Two edges of the ground plate 213 are curved in order to provide spring fingers 216. The ground plate 213 is provided with holes 214 each designed to receive a twin-ax connection element 202. In order to establish adequate electrical contact between each ground contact 211 of each twin-ax connection element 202 and the ground plate 213. Preferably, resilient lugs 215 are provided along the edges of the holes 214 as shown in FIG. 12*a*. These resilient lugs 215 may be made integrally with the ground plate 213 by well known manufacturing methods like punching and folding.

The ground plate 213 may have a width of about 11.95 mm and a height of about 14.90 mm.

During assembling the back-panel 12 with each of the twin-ax connection elements 202 the ground plate 213 is slid over the twin-ax connection elements 202 as indicated by arrows 198 in FIG. 13. Each of the twin-ax connection elements passes through a hole 214 and the spring fingers 216 are pushed against the ground pads 217 in order to establish good electrical contact. Then a housing 219 provided with openings 196 is fitted to the back-panel 12 in such a way (indicated by arrows 197) that each twin-ax connection element 202 extends through an opening 196 and the housing 219 presses the ground plate 213 against the ground pads 217. Therefore, no additional soldering of the ground plate 213 to the ground pads 217 is needed, The housing 219 is designed to receive a mating housing (not shown) provided with female type signal conductors to establish electrical contact to the male type signal conductors 207.

Although, in FIG. 13, the ground plate 213 is shown to be slid over the twin-ax connection elements 202 provided with male type signal conductors 207, the signal conductors may be female type. Moreover, as may be clear to any person skilled in the art the ground plate 213 may also be applied to coaxial connecting elements 13, 18 and 22 grouped together within a single housing 25 as shown in FIG. 1.

Figure 14:
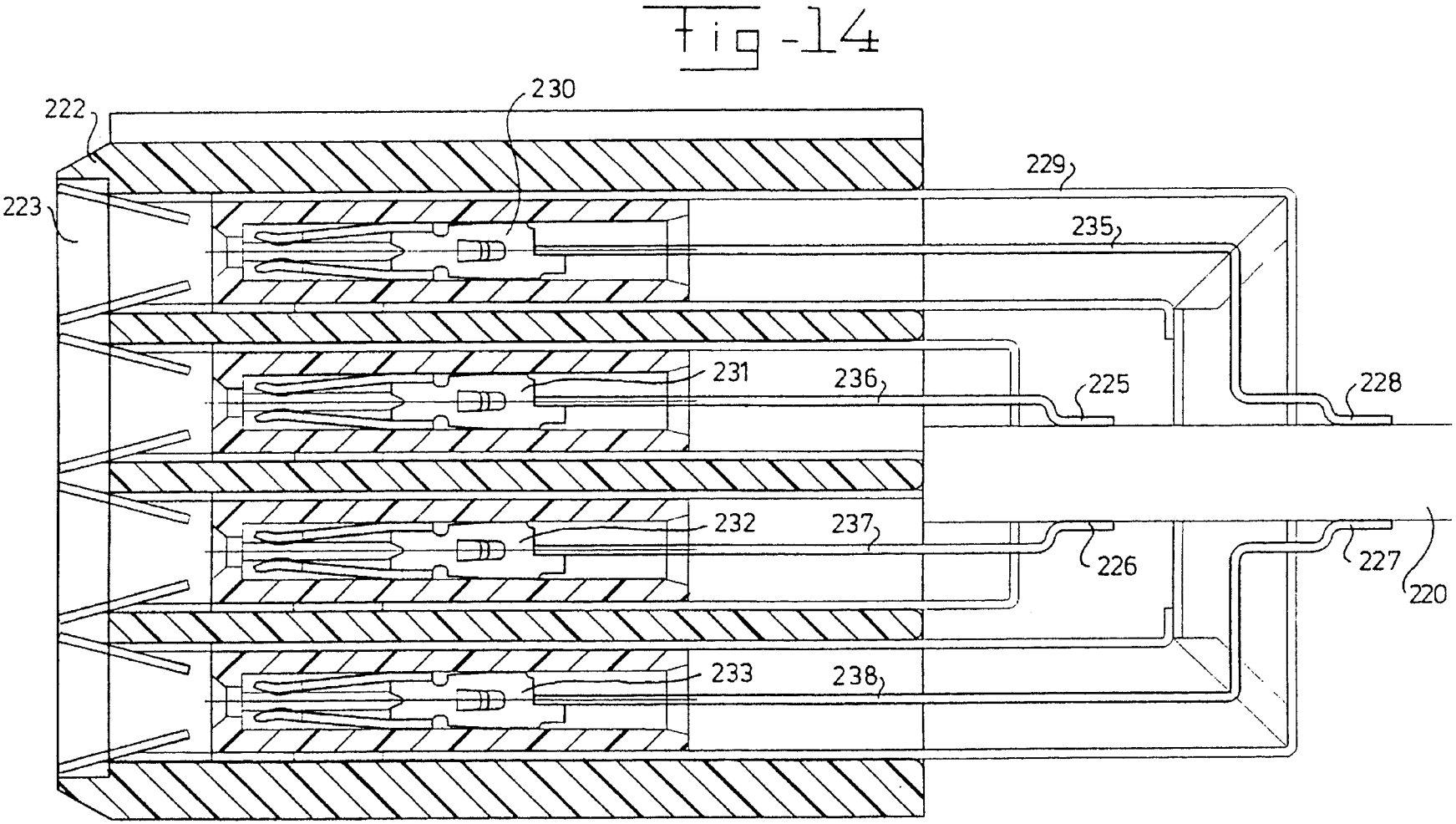
FIG. 14 shows an alternative way of mounting a connector according to the invention to a printed circuit board.

FIG. 14 shows an alternative way to mount a housing 222 provided with several signal terminals 230, 231, 232 and 233 to a printed circuit board 220. This way of mounting is called "straddle mount". In FIG. 14 housing 222 is mounted to the printed circuit board in such a way that four signal conductors 230,231, 232 and 233 extend in a direction parallel to the surface of the printed circuit board 220. Moreover, two of these signal terminals 230 and 231 are at one side of the surface of the printed circuit board 220 and they are connected to it via their signal conductors 235 and 236, respectively, and contact lugs 228 and 225, respectively. The other two of these signal terminals 232 and 233 are at the other side of the surface of the printed circuit board 220 and via signal conductors 237 and 238 and contact lugs 226 and 227, respectively, they are connected to the other side of the printed circuit board 220.

The signal terminals 230, 231, 233 and 234 may be part of a coaxial type of connection element or a twin-ax type of connection element.

All signal terminals 230, 231, 232 and 233 are preferably enclosed by an appropriate ground contact 229.

Although in FIG. 14 the signal terminals 230, 231, 232 and 233 are shown to be female type, it should be understood that the straddle mounting technique shown may also be used when the signal terminals are of the male type.

Moreover, although in all embodiments shown the signal terminals have been either female or male, any of the signal terminals may also have a hermaphroditic structure.

While the invention has been described and illustrated with reference to specific embodiments, those skilled in the art will recognize that modification and variations may be made without departing from the principles of the invention as described herein above and set forth in the following claims.

What is claimed:

1. A connector having at least one shielded terminal, each said shielded terminal comprising:

at least one signal terminal;

a ground contact surrounding said at least one signal terminal;

at least one lug extending from said ground contact, said lug capable of being slidably positioned over the surface of another ground contact of another shielded terminal in order to provide electrical and mechanical contact with said other ground contact, the surface of said ground contact being able to electrically and mechanically contact at least one other lug extending from said other ground contact and said at least one signal terminal being able to electrically and mechanically contact another signal terminal of said other shielded terminal, said other shielded terminal having substantially equal cross section dimensions as said at least one shielded terminal; and said ground contact being formed from a single electrically conducting plate and having a substantially symmetrical polygon cross section along its entire length.

2. The connector of claim 1, wherein said ground contact is provided with two lugs on at least one end of said ground contact, said two lugs being situated on said at least one end substantially opposite one another.

3. The connector of claim 2, wherein each of said two lugs extends from a respective lateral face of said ground contact and said ground contact comprises two indented small faces at the same end of said ground contact at which said two lugs are situated, each said indented small face being disposed in a different lateral face of said ground contact from which neither of said two lugs extend.

4. The connector of claim 2, wherein said ground contact is provided with two outward-extending lugs at each end of said ground contact and with two indented small faces at each end of said ground contact.

5. The connector of claim 3, wherein said ground contact is provided with two outward-extending lugs at each end of said ground contact and with two indented small faces at each end of said ground contact.

6. The connector of claim 1, wherein said at least one signal terminal is provided with at least one clamping lug to be folded around a signal conductor of an electrical cable to which the connector is to be fitted to establish a firm electrically conductive contact.

7. The connector of claim 1, wherein said signal terminal is connected to a signal conductor extending in a longitudinal direction within said shielded terminal and said signal terminal and said signal conductor being integrally made from a single blank.

8. The connector of claim 6, wherein said signal terminal comprises two signal conductor lugs having respective lateral surfaces, said two signal conductor lugs being folded over with respect to a supporting surface disposed between said two signal conductor lugs so that their respective lateral surfaces face each other.

9. The connector of claim 8, wherein said signal conductor lugs are bent towards one another thereby generating a mechanical pre-tension.

10. The connector of claim 1, further comprising a plurality of shielded terminals arranged in a plurality of columns and rows.

11. The connector of claim 1, wherein each said shielded terminal is of a coaxial type.

12. The connector of claim 1, wherein each said shielded terminal is of a twin-ax type.

13. The connector of claim 1, wherein common grounding of said ground contacts is provided by mounting said connector to a back panel having a ground pad attached thereto and by providing a ground plate having openings through which said shielded terminals can extend and having spring fingers for contacting said earth pads.

14. The method of producing said ground contact for the connector of claim 1 comprising the following steps:

(a) punching a ground contact blank from a flat plate of conductive material, said ground contact blank comprising at least one extending lug and folding lines extending in a longitudinal direction of said ground contact blank; and (b) folding said ground contact blank over said folding lines to produce said ground contact so that said ground contact has a substantially symmetrical polygon cross section along its entire length.

15. The method of claim 14 wherein said ground contact blank is provided with V-shaped openings which are arranged in such a way that after said ground contact blank is folded, said ground contact is folded at least once more to provide a substantially electrically enclosed ground contact having a predetermined angle.

* * * * *